US005745948A

United States Patent [19]

Lloyd et al.

[11] Patent Number: 5,745,948

[45] Date of Patent: May 5, 1998

[54] CONDUIT CLEANER

[76] Inventors: Samuel J. Lloyd, 11461 Glenpark Rd., NE.; Steven R. Martin, 1127 Indian Hill Dr., both of Bolivar, Ohio 44612

[21] Appl. No.: 695,453

[22] Filed: Aug. 12, 1996

Related U.S. Application Data

[63] Continuation-in-part of Ser. No. 543,237, Oct. 13, 1995, abandoned.

[51] Int. Cl.[6] ..... B08B 9/02

[52] U.S. Cl. ..... 15/104.12; 15/104.31

[58] Field of Search ..... 15/104.05, 104.09, 15/104.12, 104.31

[56] References Cited

U.S. PATENT DOCUMENTS

| | | | |
|---|---|---|---|
| 2,336,293 | 12/1943 | Pletcher | 15/104.12 |
| 2,710,419 | 6/1955 | Whitlow | 15/104.12 |
| 3,144,240 | 8/1964 | Connell | 15/104.05 |
| 4,531,250 | 7/1985 | Watanabe | 15/104.12 |
| 4,795,495 | 1/1989 | Dobson, Sr. | 15/104.09 |

FOREIGN PATENT DOCUMENTS

| | | | |
|---|---|---|---|
| 41358 | 5/1925 | Norway | 15/104.12 |
| 816481 | 7/1959 | United Kingdom | 15/104.12 |

*Primary Examiner*—Mark Spisich
*Attorney, Agent, or Firm*—Michael C. Pophal; Ralph E. Jocke

[57] ABSTRACT

An apparatus for cleaning conduits which includes a generally cylindrical body (12) having a bore adapted at one end for connection with a high pressure fluid source. The body includes a groove (26) extending circumferentially about the exterior of the body. The body further includes a port (28) which extends through the body from the bore to the groove. The conduit cleaning apparatus further includes an annular rotor (32) having a central rotor bore (34). The annular rotor is positioned about the body for rotation thereon. The annular rotor further includes at least one orifice (46) extending through the annular rotor from the bore to the exterior of the annular rotor. The orifice is positioned in communication with the groove when the annular rotor is positioned for rotation on the body. The conduit cleaner apparatus further includes a wire (48) attached to the annular rotor. The wire is manufactured from braided stainless steel wire, and is highly abrasive and shearing to objects which it contacts. In operation water flows from the high pressure source through the body bore to the port to the groove, and then through the orifice, causing the rotation of the annular rotor with the attached wire on and relative the body. The wire extends radially away from the annular rotor into a tensioned position.

14 Claims, 9 Drawing Sheets

CONDUIT CLEANER

CROSS-REFERENCES TO RELATED APPLICATION

This is a continuation in part of prior application Ser. No. 08/543,237, filed on Oct. 13, 1995, now abandoned.

TECHNICAL FIELD

This invention relates to conduit cleaning devices, particularly to hydraulically powered conduit cleaning devices with rotating cutting attachments.

BACKGROUND ART

Devices which clean sewers and other conduits are well known in the art. These prior art devices are designed to sparge and route accumulated sediment and other occlusions from the interior of conduits such as sewers and drainage pipes.

Generally, hydraulically powered conduit cleaning devices are attached to a high pressure water source and are fed through a man hole into a sewer or other conduit that is to be cleaned. Prior art cleaning devices are advanced through the conduit, spraying the high pressure water onto the walls of the conduit resulting in the loosening and flushing of the contents of the conduit. Prior art cleaning devices have included spray nozzles. Other prior art devices have included a rotor which produces a rotating water spray which acts to concentrate the force of the high pressure water onto the walls of the conduit, thus improving the cleaning and flushing operation. These devices suffer from the inability to dislodge fixed water insoluble occlusions in the conduit such as tree roots. Such material remains fixed on the interior of the conduit wall and is unaffected by the high pressure spray.

Other prior art devices have included a rigid cutting blade attached to a rotor of a hydraulically powered cleaning device. These prior art devices also have included a frame within which the cutting blade rotates which acts to center the cutting blade and prevent it from contacting the interior surface of the conduit. These prior art devices suffer from their inability to bore into root structures or otherwise pass dense accumulations of materials in the conduit. These prior art devices also suffer from high weight and inflexibility which often restricts their use to straight passages of conduit. The frame of such devices also restricts the movement of device into any conduit the diameter of which is smaller than the frame.

The cutting blades of certain prior art devices are rigid with a sharp leading edge. When such a blade impacts woody root structures which it cannot completely sever, the rotation is halted and the torque from the spraying nozzles acts to twist and tangle the hose. The blade often cannot free itself from the obstruction, thus making removal of the cutter from the conduit difficult.

When the cutting blades of prior art devices encounter woody root structures clinging to the surface of conduits, they suffer from the inability to impact and therefore remove the root.

Thus there exists a need in the prior art for an apparatus which cleans conduits which is self centering, light weight, is capable of advancing past and removing fixed water insoluble occlusions from conduit walls and can quickly clean and rout materials found in underground conduits.

DISCLOSURE OF THE INVENTION

An object of the present invention is to provide an apparatus for cleaning conduits which is self centering in the conduit and capable of advancing through changes in the interior diameter of the conduit.

A further object of the present invention is to provide an apparatus for cleaning conduits which produces a high pressure scouring water jet at a low volumetric flow rate.

A further object of the present invention is to provide an apparatus for cleaning conduits which has a high rotation rate produced by low volumetric flow rate and which produces a rotational force capable of advancing a cutting blade through foreign objects within the conduit walls.

A further object of the present invention is to provide an apparatus for cleaning conduits which creates a vacuum which draws root structures into the path of the cutting blades.

A further object of the present invention is to provide an apparatus for cleaning conduits which is deformable and capable of being advanced through passages with diameters smaller than that of the conduit.

Further objects of the present invention will be made apparent from the following Best Modes For Carrying Out Invention and the appended claims.

The foregoing objects are accomplished by a conduit cleaning apparatus. The conduit cleaning apparatus comprises a generally cylindrical body having a bore. The body extends between a first end and a second end. The body includes an opening of the bore adjacent the first end which is adapted for connection with a high pressure fluid source. The diameter of the second end of the body is reduced, and is smaller than the diameter of the first end.

The outer surface of the second end includes a groove extending circumferentially about the exterior of the body. The second end of the body further includes at least one port extending through the second end from the bore to the outer surface of the second end. The port extends through the body from the bore to the groove.

The apparatus further includes an annular rotor. The annular rotor has a central cavity, wherein the second end extends through the central cavity and the annular rotor is rotatably mounted on the body. The annular rotor further includes at least one orifice extending through the annular rotor from the cavity to the exterior of the annular rotor. Each orifice is positioned to direct the fluid generally tangentially from the rotor. Each orifice also is positioned to direct the fluid behind the apparatus wherein the fluid directed backwards forces the apparatus forward in the conduit.

The annular rotor further comprises an annular bearing. The annular bearing is positioned adjacent the central cavity and affixed to the surface thereof. The annular bearing decreases the friction between the stop and the annular rotor. Each orifice extends through the annular bearing to allow fluid communication with the groove.

The apparatus further comprises a stop and a bearing. The stop is connected to the body to hold the axial position of the annular rotor on the body. The bearing is interposed between the stop and the annular rotor. The bearing decreases the rotational friction between the stop and the annular rotor.

In the preferred embodiment of the annular rotor the annular rotor includes two orifices. The orifices being positioned in the annular rotor to direct the fluid in generally opposed directions. Alternatively the annular rotor can further include at least one reverse orifice. The reverse orifice is also positioned to direct the fluid generally tangentially from the rotor but in an opposite angular direction from the forward directed orifices. When fluid flows from the reverse orifice the annular rotor rotation is slowed.

The orifices direct fluid in both the tangential and reverse directions to both apply a rotational force to the annular rotor and a forward force to the apparatus. These two functions can be split by positioning the orifices on the annular rotor in the generally tangential direction. This alternative embodiment further includes at least one thrust orifice. The thrust orifice is positioned on the first end of the body. Each thrust orifice is positioned to direct the fluid behind the apparatus wherein the fluid moving backwards forces the apparatus forwards.

Although in the preferred embodiment of the invention the fluid is directed through orifices, alternatively nozzles can be used. In the alternative embodiment each orifice is tapped and a nozzle is threaded into the orifice. The nozzles are therefore easily removable and insertable, and different nozzles with different flow rates, spray patterns and directions can be utilized for different applications.

The apparatus further includes at least one wire attached to the annular rotor. Each wire extends through the annular rotor and is fixed within the annular body. A portion of the wire extends from opposed outer surfaces of the annular rotor. The wire preferably comprises a braided wire, and alternatively can comprise a monofilament wire.

The body is in operative fluid communication with the high pressure fluid source through a hose. This hose often is weighty enough or rigid enough to force the apparatus into a wall of the conduit. Therefore the apparatus further comprises a lead line. The lead line is fluidly connected to both the body and the hose, and is operative to communicate the fluid from the hose to the body. The lead line is flexible and when the apparatus is placed within a conduit the lead line allows the body to move to a position disposed from the surface of the conduit.

In the operation of the conduit cleaner, water flows from the high pressure source through said body bore to the ports to the groove. Water then flows through the orifices, causing the rotation of the annular rotor. Rotation of the rotor rotates the wires. As the annular rotor rotates, the wires extend radially away from the annular body into a tensioned position.

BRIEF DESCRIPTION OF DRAWINGS

A preferred embodiment of the invention, a device for cleaning conduits is described hereunder in detail with a reference to the accompanying drawings.

BEST MODES FOR CARRYING OUT INVENTION

Figure 1:
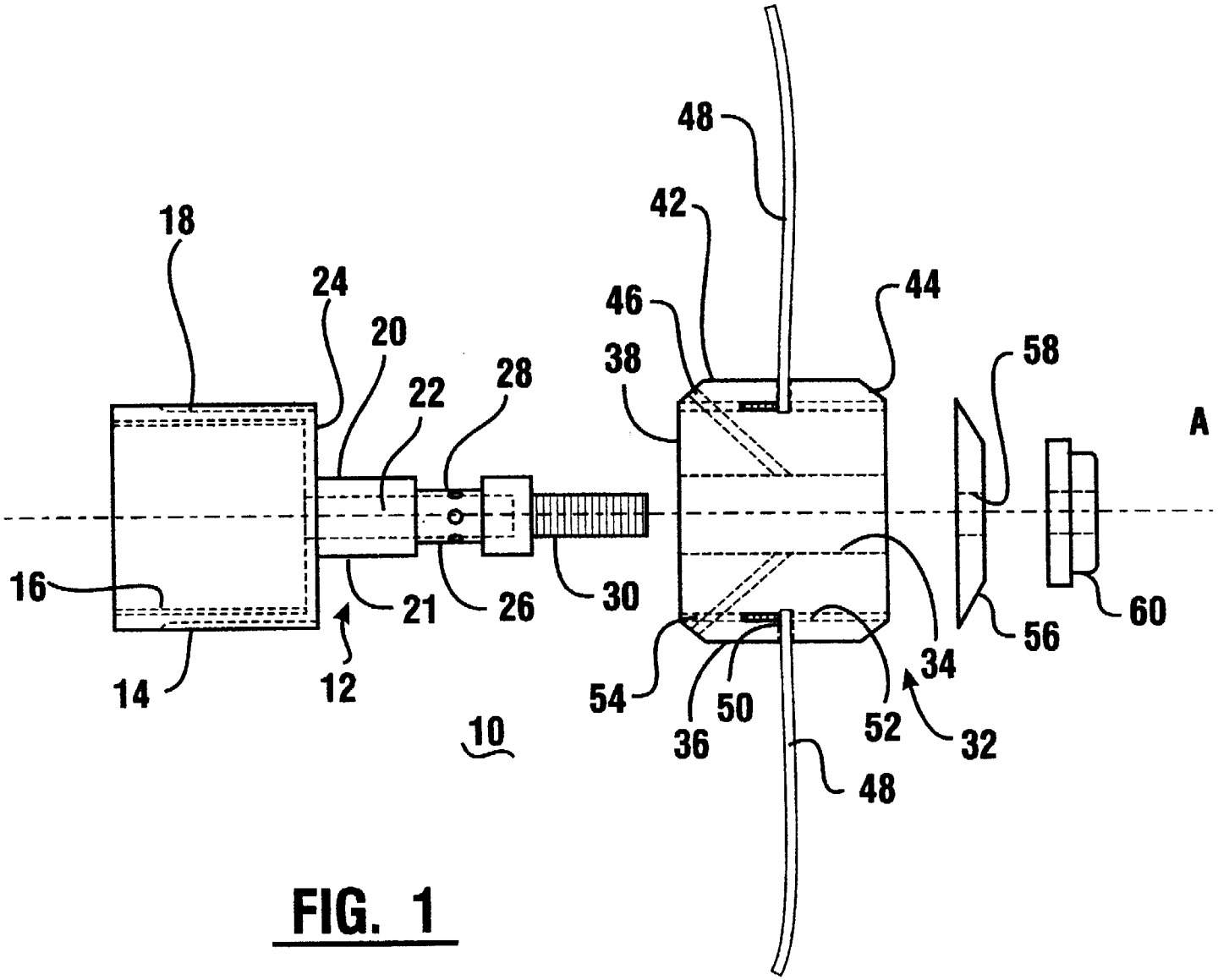
FIG. 1 is an exploded view in cross section of a first embodiment of the apparatus for cleaning for conduits of the present invention.
Figure 2:
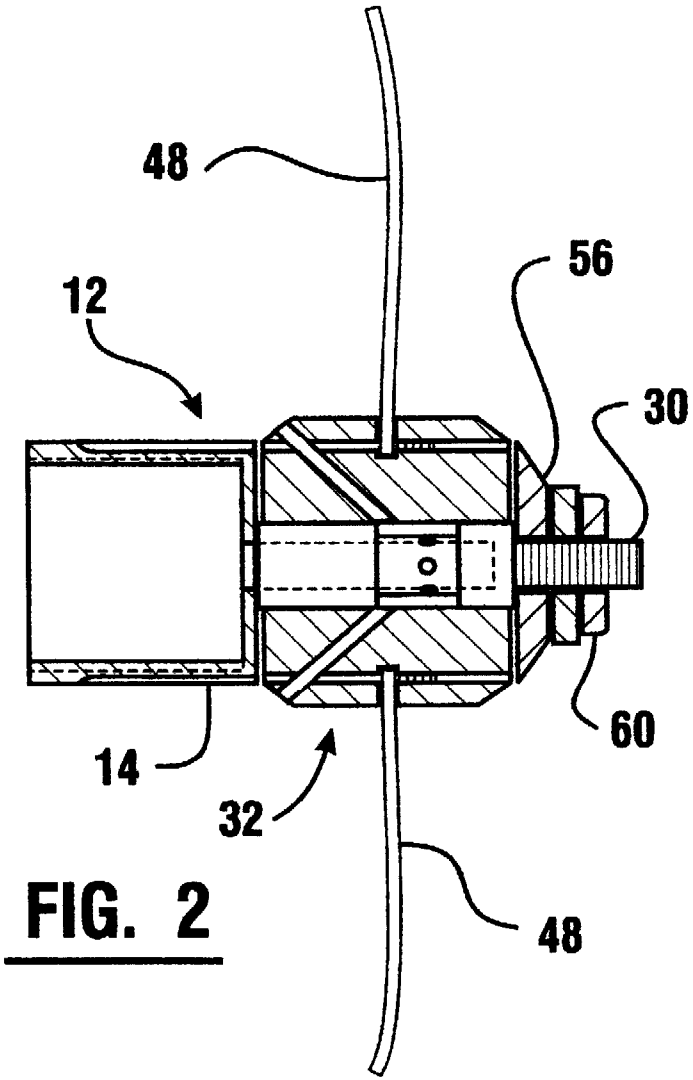
FIG. 2 is a cross sectional view of a first embodiment of the apparatus for cleaning conduits of the present invention.
Figure 3:
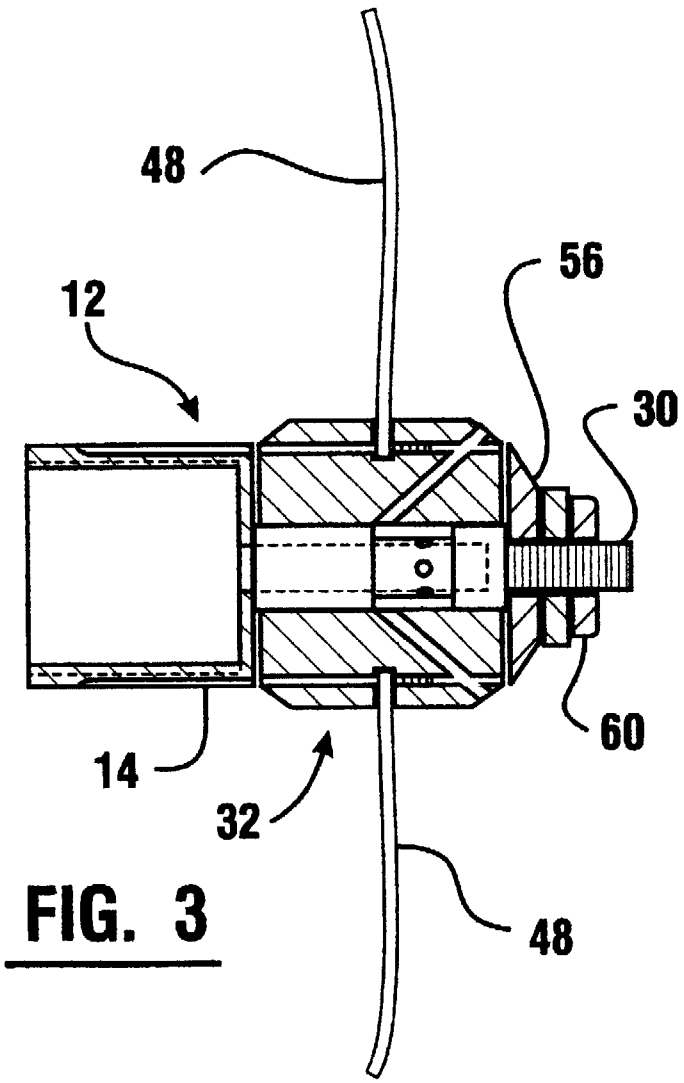
FIG. 3 is a cross sectional view of an alternative embodiment of the apparatus for cleaning conduits in which the orifices are directed to spray away from the body.

Referring now to FIGS. 1 and 2, a first embodiment of the apparatus for cleaning conduits of the present invention is shown. A conduit cleaner 10 comprises a body 12 which is generally cylindrical and aligned axially along an axis A. The body 12 includes a base portion 14. The base portion includes a screw threaded bore 16 adapted for acceptance of the male threaded end of a high pressure hose connection. The bore extends through the base portion 14. The base portion 14 further includes a pair of wrench accepting depressions 18 on the exterior of the base portion in generally opposed relation. The depressions 18 aid in the securing of the base portion onto a fitting or coupling at the termination of the high pressure water hose. Alternatively the base portion can include other connection means capable of communicating high pressure water from the hose to bore 16 of the base portion 14, such as a flanged connection or a quick coupling connection.

The base portion 14 further includes a bearing portion 20 which is generally cylindrical and has a smooth external surface 21. The diameter of the bearing portion is smaller than the diameter of base portion 14. A fluid passage 22 extends through the center of the bearing portion 20 and is in communication with bore 16. A proximate end of bearing portion 20 is adjacent a face 24 of body 12. The proximate end of bearing portion 20 is separated from a distal end of bearing portion 20 by a groove 26. The groove 26 extends circumferentially about bearing portion 20 and communicates with fluid passage 22 via a plurality of ports 28. The ports 28 are arranged equidistant from each other and extend radially from the fluid passage 22 to groove 26. Communication between the groove 26 and fluid passage 22 can alternatively be accomplished via any passage with sufficient cross section area to allow fluid to flow from fluid passage 22 freely into groove 26.

Body 12 further includes a threaded portion 30 which extends axially from the bearing portion. The diameter of the threaded portion is smaller than the diameter of the bearing portion.

The conduit cleaner further includes an annular rotor 32. Annular rotor 32 includes a central rotor bore 34 which is aligned along the axis A. The external surface of the central rotor bore is smooth and sized for acceptance of the bearing portion 20 in close fitting relation. The annular rotor has a smooth outer surface 36 extending circumferentially. Rotor 32 further has a first radial surface 38 which is positioned adjacent face 24. Annular rotor 32 further includes a second radial surface 40 positioned opposite the first radial surface 38 and disposed from face 24. The outer surface 36 of annular rotor 32 further includes a first and second bevelled surfaces 42 and 44 which extend circumferentially about the annular rotor and generally traverse an acute angle relative axis A.

The annular rotor 32 further includes a plurality of orifices 46. The orifices extend from the central rotor bore 34 to the outer surface of the annular rotor 32. The opening of the orifices 46 adjacent to the central rotor bore 34 is positioned adjacent to and in communication with groove 26 when annular body is positioned over bearing portion 20. This positioning allows high pressure fluid to flow from bore 16 through fluid passage 22. Fluid then flows through ports 28 to groove 26, and then through annular rotor 32 via orifices 46.

Figure 4:
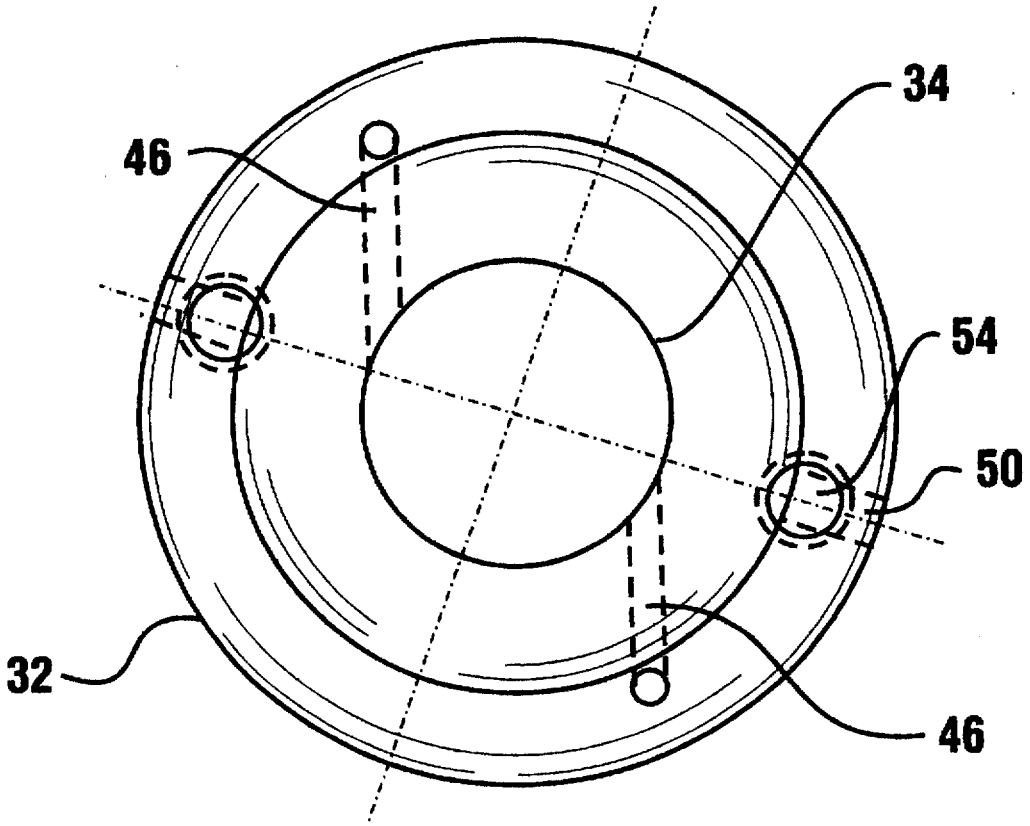
FIG. 4 is a cross sectional view of the annular rotor of the apparatus for cleaning conduits.

The orifices preferably extend both angularly and tangentially relative the surface of central rotor bore 34. This positioning results in a substantial rotational force on annular rotor 32 due to the flow of high pressure fluid therethrough. The angle of the orifice relative the axis A can range from a minimum angle when positioned radially to a maximum angle when positioned tangentially. The net rotational force also varies with this angle from a minimum force when the orifice angle is positioned radially to a maximum force when the orifice angle is tangential. As shown in FIG. 4, the preferred embodiment of the invention the rotation force is maximized by positioning the orifice at the tangential angle.

The net axial force on the conduit cleaner is also affected by the position of the orifices. As shown in FIG. 1, the orifices of the preferred embodiment of the invention extend through the outer surface of the annular body at the first bevelled surface 42. The position of the orifices results in a net force with the direction of travel of the conduit cleaner 10. Thus the water flowing from the orifices tends to advance the conduit cleaner into the conduit. This positioning results in a scouring of material on the interior surface of the conduit behind the conduit cleaner. Alternatively, the intersection of the orifices with the outer surface of the annular body can be at the second bevelled surface 44. In this position of the orifices the net axial force on the conduit cleaner is opposed the direction of travel.

In the preferred embodiment of the invention there are two orifices 46 which are positioned generally opposed to each other in the annular rotor 32. A net zero radially force produced by this arrangement results in a self centering of the conduit cleaner within the conduit. The force of each respective orifice fluid stream on the conduit wall forces the conduit cleaner towards the center of the conduit. Alternatively, additional pairs of orifices can be added to the annular rotor which add additional scouring streams but still result in the self centering force.

The conduit cleaner 10 further includes at least one cutting wire 48. In the preferred embodiment the wires attach at one end to the outer surface of the annular rotor 32. The wire preferably comprises a braided stainless wire saw which is flexible and of high tensile strength. The braids protrude from the generally cylindrical outer face of the wire, the protrusions being raised in regular patterns the entire length and circumference of the wire.

The braided texture of the wire results in the wire being abrasive to an object when the wire moved relative the object in any direction. The preferred form of the braided cutting wires 48 are used by veterinarians as surgical saws to cut through animal flesh and bone. Alternatively, the saw can comprise any flexible wire which is abrading when in contact with an object in any direction along the surface of the wire.

A second alternative embodiment of the wire comprises a monofilament wire. The monofilament wire can be used in plastic conduits which would be abraded by the braided wire. The monofilament wire cuts material it contacts as it proceeds at high speeds in the conduit. The smooth surface of the wire does not abrade as it deflects but acts to sever objects it contacts.

Each wire 48 is nested at one end in a radial bore 50 of the annular rotor 32. Each wire is fixed in the radial bore by a set screw 52 which is positioned within a threaded axial bore 54. Thus fixed each wire is rotated with the annular rotor about the axis A. Alternative means for fixing said wire in annular rotor 32 include having a passage which extends through the annular rotor through which a single wire can be extended.

Figure 6:
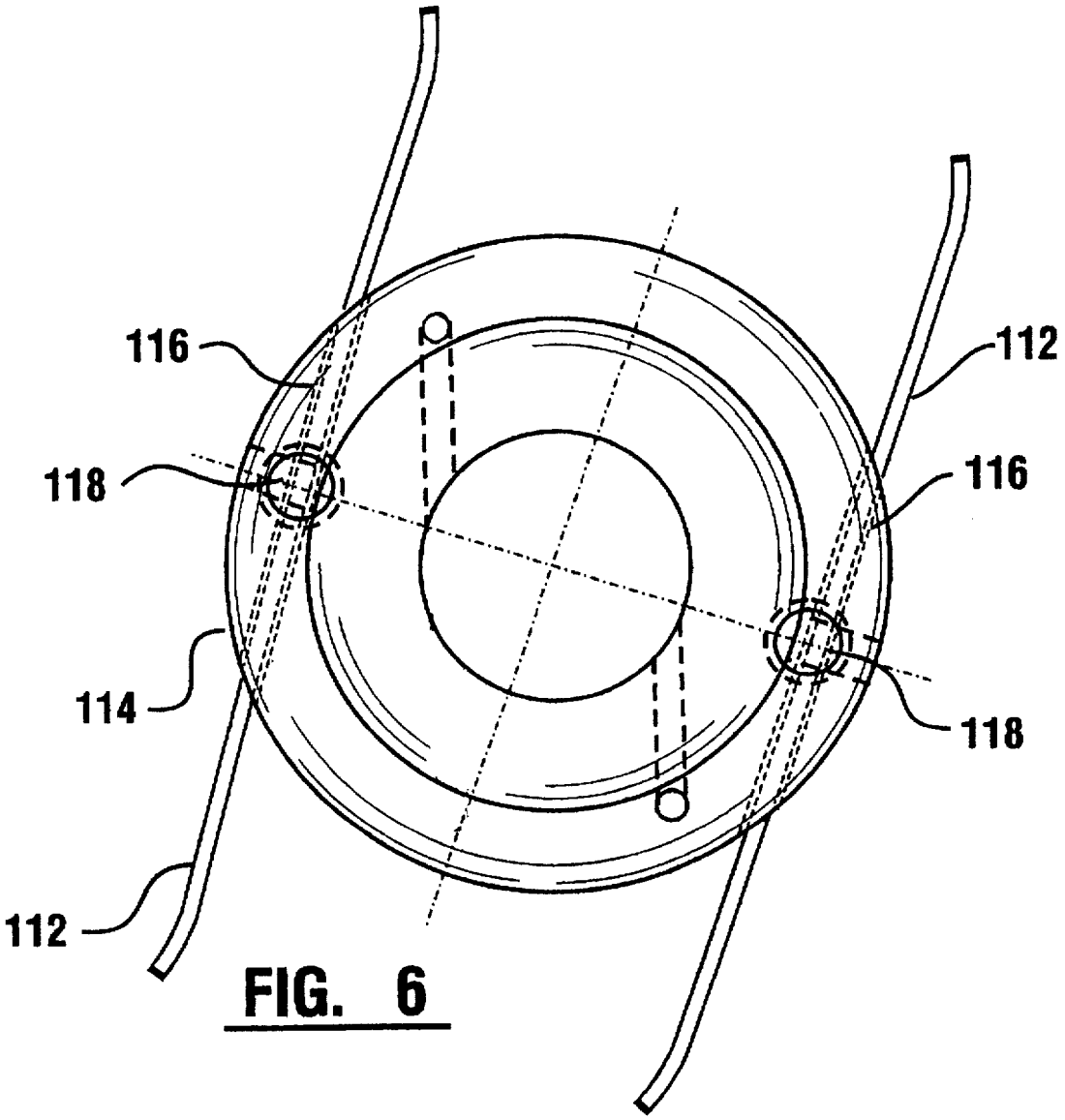
FIG. 6 is a cross sectional view of the annular rotor of the apparatus for cleaning conduits with multiple wires attached.

Referring now to FIG. 6 there is shown an alternative means of attaching multiple wires 112 to the annular rotor 114. Each wire extends through a passage 116 positioned along a chord of annular rotor 114. Each wire is fixed into position within the passage by a set screw 118 positioned in an axial passage which intersects with the passage 116. The multiple wires present more surface for the abrasion of material accumulated within the conduit.

The conduit cleaner further includes a spacer 56. The spacer has an internal hole 58 sized to accept the threaded portion of body 12. The spacer further has smooth radially extending outer and inner surfaces for the reduction of sliding friction. The conduit cleaner 10 also includes a castellated nut 60 with a plastic insert to hold the annular rotor on bearing portion 20 for rotation thereon. The castellated nut and the plastic insert lock both the annular rotor and spacer 56 on to the body 12. Alternatively, other means of locking can be used.

In operation when the conduit cleaner 10 is connected to a source of high pressure water the water flows from the high pressure source through bore 16 into fluid passage 22. The water flows into groove 26 through ports 28. Water pressure is held within groove 26 by the close fitting surfaces of the bearing portion surface 21 and the smooth surface of rotor bore 34. The pressurized water flows from groove 26 through orifices 46. The rotational thrust from the water flowing through orifices 46 results in a rotation of the annular rotor 32 about the bearing portion 20. The rotation of annular rotor 32 causes cutting wires 48 to also rotate with the outer surface of the annular rotor. The centrifugal force associated with the rotation causes the wires to fully extend into an elongated tensioned position in alignment with a radial direction which is generally normal relative axis A.

The rotation of annular rotor 32 about bearing portion 20 causes potential friction between the inner surface of central rotor bore 34 and the outer surface 21 of the bearing portion 20. Friction may also be generated between the first radial surface 38 and face 24 of body 12 and the second radial surface 40 and the inner surface of spacer 56. These surfaces are both cooled and lubricated by a small quantity of water flowing from groove 26 between the inner surface of the central rotor bore 34 and the surface 21 of bearing portion 20. As the fluid pressure increases and the rate of rotation increases, the cooling water flowing between these friction surfaces also increases to avoid excessive friction.

All of the components of the conduit cleaner are manufactured from hardened and/or stainless steel. The high thermal conductivity of the steel acts to transmit frictional heat to the fluid flowing between the mating surfaces. The high density of the steel annular rotor imparts inertia which acts to prevent the deceleration of the attached wires when the wires contact foreign material within the conduit. Alternatively, other materials can be used which is capable of maintaining its shape under the high fluid pressure encountered, and is capable of withstanding the high rotational speeds and impact resistance required.

The conduit cleaner 10 can operate at a wide range of water pressures. The water usage rate increases as the water pressure increases. In the preferred embodiment the base portion is adapted to connect to a ¼ inch hose. With the two tangential orifices 46 it has been found that 3.5 gallons per minute of water is used by the unit at a pressure of 1600 PSI. At a pressure of 3500 PSI the flow rate through the orifices increases to 10 gallons per minute. In this pressure range the annular rotor 32 of the unit rotates at or about 4000 RPM. At these high RPMs the water leakage rate adequately cools the moving components. The water cooling rate is so effective as to allow the use of heated water as the pressure source. Water temperatures up to 210° F. have not resulted in any problem corresponding with component volumetric expansion.

The conduit cleaning apparatus can also be modified to connect to larger size hoses. These larger sized conduit cleaners are adapted for larger volumetric flow rate which can be provided by the larger hoses. The conduit cleaning apparatuses are sized by the hose size they are adapted to fit. A ⅛ inch conduit cleaner is rated at four gallons per minute flow rate at 1600 PSI, and 30 gallons per minute flow rate at 4500 PSI. A ½ inch conduit cleaner is rated at 60 gallons per minute flow rate, and larger sized conduit cleaners are available for higher flow rates.

In operation the conduit cleaner 10 is first attached to a high pressure hose and high pressure water source. As discussed, the temperature of the water source can range from ambient to sub-boiling, although high temperature water is preferable. Cutter wires of the appropriate length are fitted to the conduit cleaner so that the diameter to the tips of the extended wires closely matches the interior diameter of the conduit to be cleaned. If the conduit is plastic, a monofilament wire is attached. For all other applications, the braided wire is used.

The conduit cleaner is now ready for insertion into the conduit. The conduit cleaner and hose are fed to the conduit via a clean out portal or other opening. The conduit cleaner and hose are relatively light and deformable so as to be able to pass through traps and conduits smaller than the diameter of the conduit to be cleaned. The water pressure can be initiated upon insertion into the connecting passage or upon the arrival of the conduit cleaner in the conduit. Once the water pressure is initiated the high pressure hose is manually or mechanically fed through the passage and the conduit cleaner is advanced through the conduit.

In the preferred embodiment the orifices of the annular body are positioned in a backward direction, and the water pressure exerts a force tending to advance the cleaner through the conduit. Whereas in alternative embodiments in which the orifices are pointing in a forward direction away from the hose, the water pressure exerts a force opposite the direction of travel of the cleaner into the conduit. With the orifices pointed in the forward direction the water pressure tends to act as a boring means by loosening and scouring the conduit forward of the conduit cleaner position. When the orifices are pointed in the backward direction the water pressure tends to scour the walls of the conduit cleaner that have been routed by the wire 48. The backward directed water tends to push the released material and debris backward of the advancing conduit cleaner 10.

The radial force of the water pressure impacting the interior surface of the conduit being cleaned tends to center the conduit cleaner within the conduit. This centering of the conduit cleaner results in the wire not as strongly impacting the interior surface of the conduit unless there is material obstructing the interior of the conduit. Should the conduit cleaner be off center, the brushing of the tip of the wire onto the surface of the conduit also has a centering affect on the conduit cleaner. When the conduit cleaner encounters material protruding from the interior surface of the conduit it is both attacked by the scouring water flowing from the orifices and abraded and cut by the wire 48. The pressurized hot water tends to help dissolve, loosen and force all accumulated sediment and other material from the conduit walls.

Figure 10:
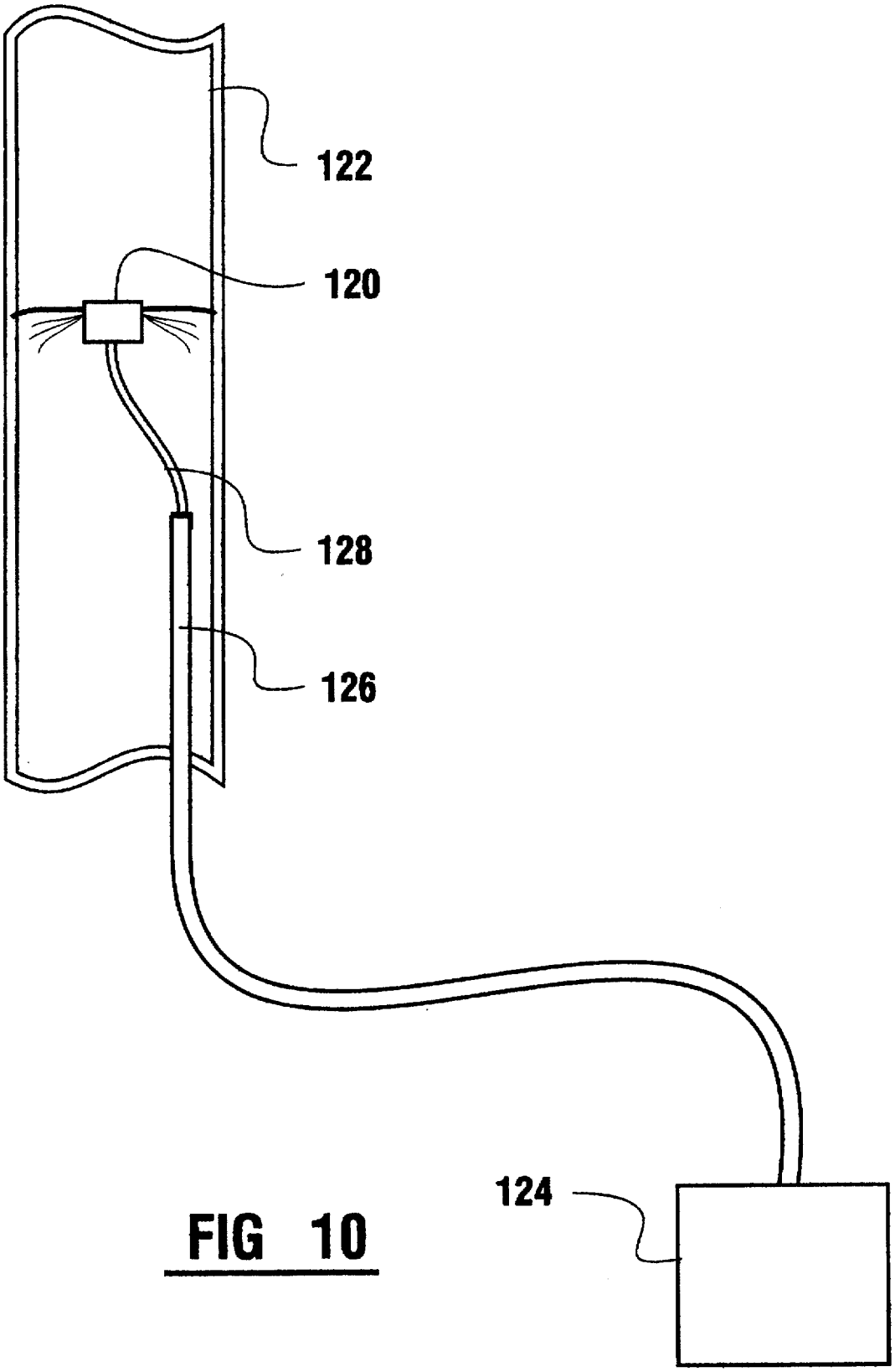
FIG. 10 is a schematic of the embodiment of the apparatus for cleaning conduits of the present invention with a lead line.

Larger hoses tend to be inflexible and their weight can often force the conduit cleaner against the surface of the conduit despite the self-centering ability of the conduit cleaner. Referring now to FIG. 10, there is shown a schematic view of the hose system for supplying fluid to the conduit cleaner 120 within the conduit 122. A pressurized fluid supply 124 supplies pressurized fluid through a hose 126. The hose is connected to a lead line 128 which is interposed between the hose 126 and the conduit cleaner 120. The lead line is lighter than the hose, flexible and of a suitable length to allow the conduit cleaner to center itself within the conduit 122 while the hose is engaged with a bottom surface of the conduit. The lead line is preferably of the same diameter as the hose, but can also act as a transition piece to match different sized hoses and conduit cleaners.

The water pressure by itself can be effective on small roots and an other fibrous material. However to effectively clean the conduit of larger roots the sawing action of the wire is required. When the wire encounters a protruding root the wire deflects upon impact with the surface of the root causing the length of the wire to run along the surface of the root. The braided stainless mesh of which the wire is composed abrades the surface of the root removing a portion thereof. The high speed rotation of the wire also acts to provide a hacking affect of the wire upon any root surface. Therefore the wire can often sink deeply into the root surface resulting solely from the momentum of the wire. Once within the root material the rough external surface of the wire is then drawn through the root removing large amounts of root material. As the conduit cleaner is advanced through the conduit the wire acts as a saw removing adjacent cross sections of root material until the entire root structure has been removed from the interior of the conduit.

If the conduit is entirely occluded with sediment and/or root material, the conduit cleaner of the present invention acts to bore through the material. As the conduit cleaner is advanced toward the occlusion, the orifices direct hot water jets at high velocity which impact upon the occlusion and act to dissolve and remove accumulated sediment from the occlusion. If the occlusion is composed entirely of hot water soluble material or material removable by the force of the orifice jets, then the action of the jets can break up the occlusion. As the conduit cleaner is advanced to contact the occlusion, the wires 48 deflect and abrade the interior surface of the occlusion. As the wires are moved to engage the occlusion, they remove material from the interior of the occlusion, thus opening the interior diameter of the occlusion. The wires move to contact the obstruction continuing the material removal process, which continues until the entire cross section of the occlusion is removed. As the material is removed, the material is forced behind the cleaner by the jets. This process is continued as the conduit cleaner is advanced through the occlusion.

Figure 5:
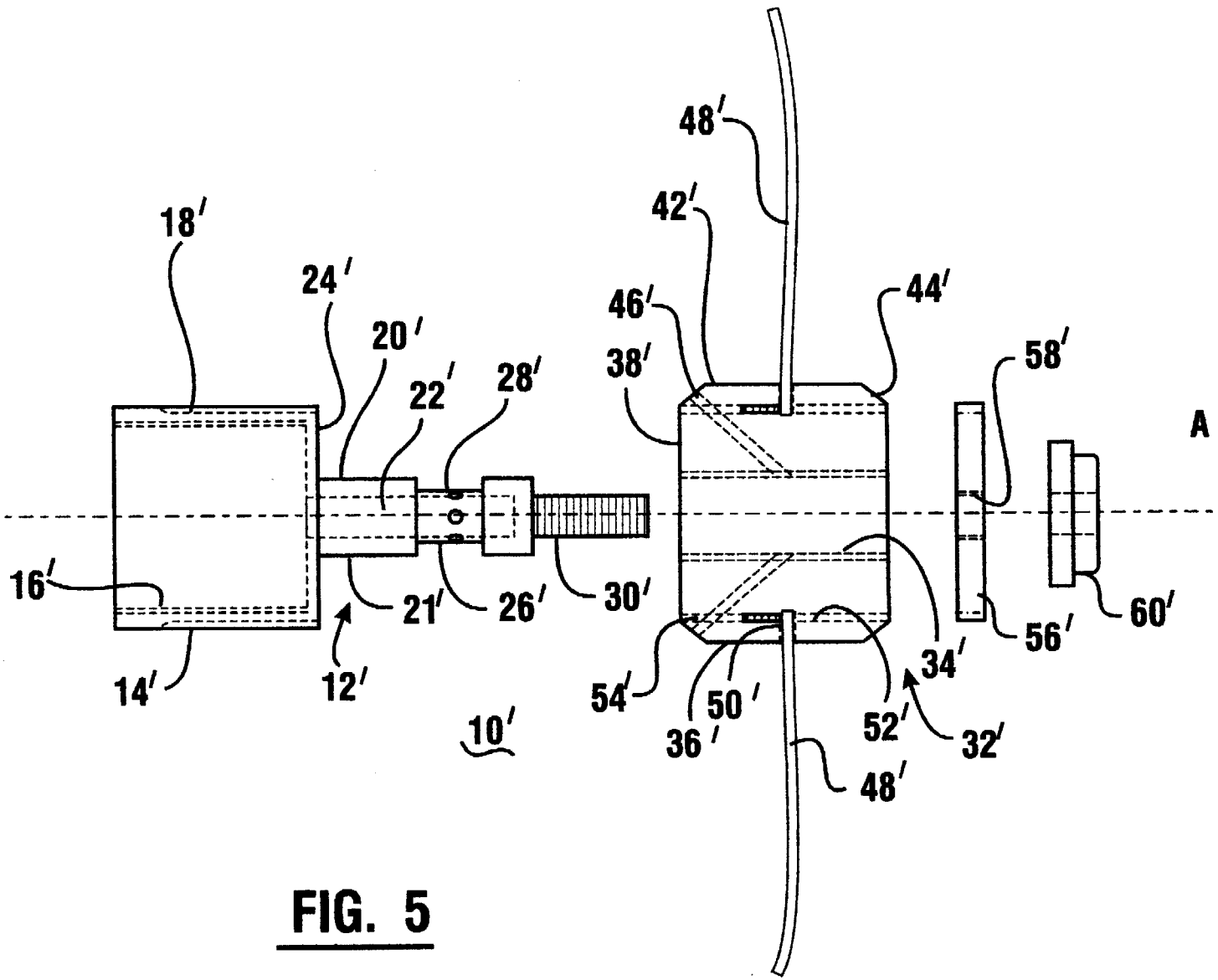
FIG. 5 is an exploded cross sectional view of a second embodiment of the apparatus for cleaning conduits of the present invention.

Referring now to FIG. 5 there is shown a second embodiment of the apparatus 70 for cleaning conduits of the present invention. In FIG. 5, those elements which are identical to the first embodiment shown in FIGS. 1 and 2 are shown primed. For the first embodiment there was described an apparatus which used leaking fluid as its only lubricant. In certain applications, where extremely high flow rates of fluid throughput are used, there are associated high rotational speeds, and additional frictional force come into play, which may require additional anti-friction mechanisms.

In the apparatus 70, anti-friction mechanisms are used to alleviate the friction between the central rotor bore 34' and the bearing portion 20', and also between the second radial surface 40' and the castellated nut 60'. To alleviate the rotational friction between the central rotor bore 34' and the annular rotor 32' an annular shaped fitting 72 is added. The fitting 72 is positioned adjacent the surface of the central rotor bore 34'. The fitting 72 is drilled so that the orifices 46' extend through the fitting. The fitting is preferably manufactured from sintered bronze so that it can be easily impregnated with a suitable lubricant. Alternatively the fitting can be manufactured from any material which can withstand the high speed frictional forces involved while maintaining its shape. In experiments the fitting 72 has withstood rotational speeds up to 10,000 RPM while remaining undamaged while preventing the apparatus 70 from ceasing.

The apparatus 70 further includes an annular bearing 74. With the high flow rates through the orifices 46' there are inherent thrust forces which bias the annular rotor 32' forward against the castellated nut 60. The annular bearing 74 is composed of a caged, lubricated and sealed bearing filled race which allows an outer portion 76 to rotate fully against an inner portion 78. While the castellated nut 60' engages the inner portion 78 the outer portion 76 remains free to rotate with the annular rotor 32'. In the preferred form of the conduit cleaner apparatus 70, the annular bearing is a ¾ inch thrust bearing manufactured by Sidko Fafnir. It should be understood that while the Sidko Fafnir bearing is capable of sealing out sediment and other particles and is capable of rotating at the high speeds, upwards of 10,000 RPM, other suitable bearings could also be utilized.

With the anti-friction bearings 72 and 76 the conduit cleaning apparatus is capable of performing at very high rotational speeds, and operates as described above with regards to the first embodiment. The high rotational speeds are capable of creating a strong vacuum in the conduit which draws material such as roots clinging to the surface of the conduit into the cutting wires of the conduit cleaner.

Figure 9:
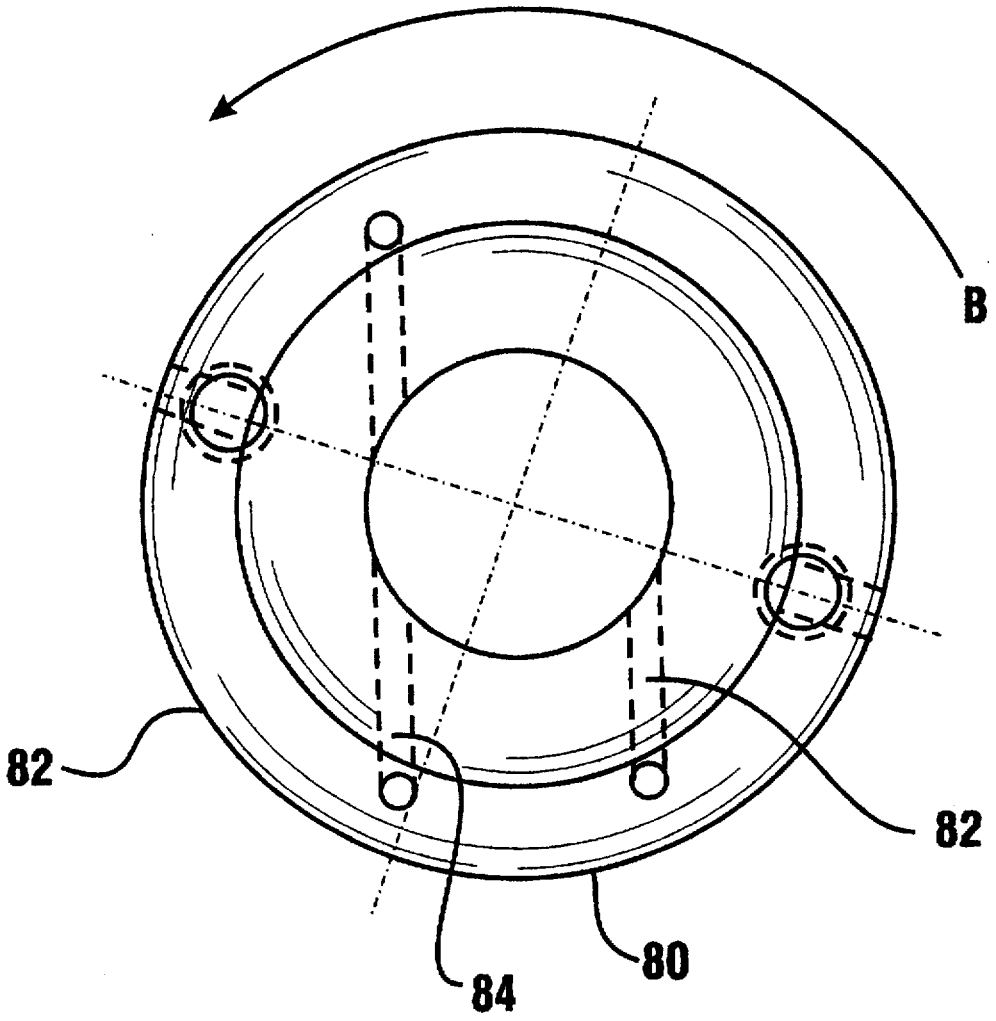
FIG. 9 is a cross sectional view of the annular rotor of the apparatus for cleaning conduits with a reverse jet.

If these high rotational speeds are not required where a high fluid flow rate is still desirable, a reverse jet can be added to the annular rotor to slow the rotational speed. Referring now to FIG. 9 there is shown a cross-sectional view of the annular rotor 80. Positioned within the annular rotor are two orifices 82 which act as exit conduits for fluid flowing from the annular rotor. The tangential positioning of the orifices acts to create a force which rotates the annular rotor in direction B. As described above, the flow rates of fluid through orifices directly correlates with the rotational speed of the annular rotor when the orifices are all positioned as shown in FIG. 9. When it is desired to maintain or increase the flow rate while decreasing the rotational speed, a reverse jet 84 can be used. Fluid flow from the reverse jet acts to create a force tending to rotate the annular jet in a direction opposite to direction B.

The diameter of the reverse jet can be varied to modify the net rotational force on the annular rotor. As will be more fully described below the reverse jet can also be blocked or restricted with nozzles for on-site modification of the rotational speed and flow rate characteristics of the annular rotor.

Figure 7:
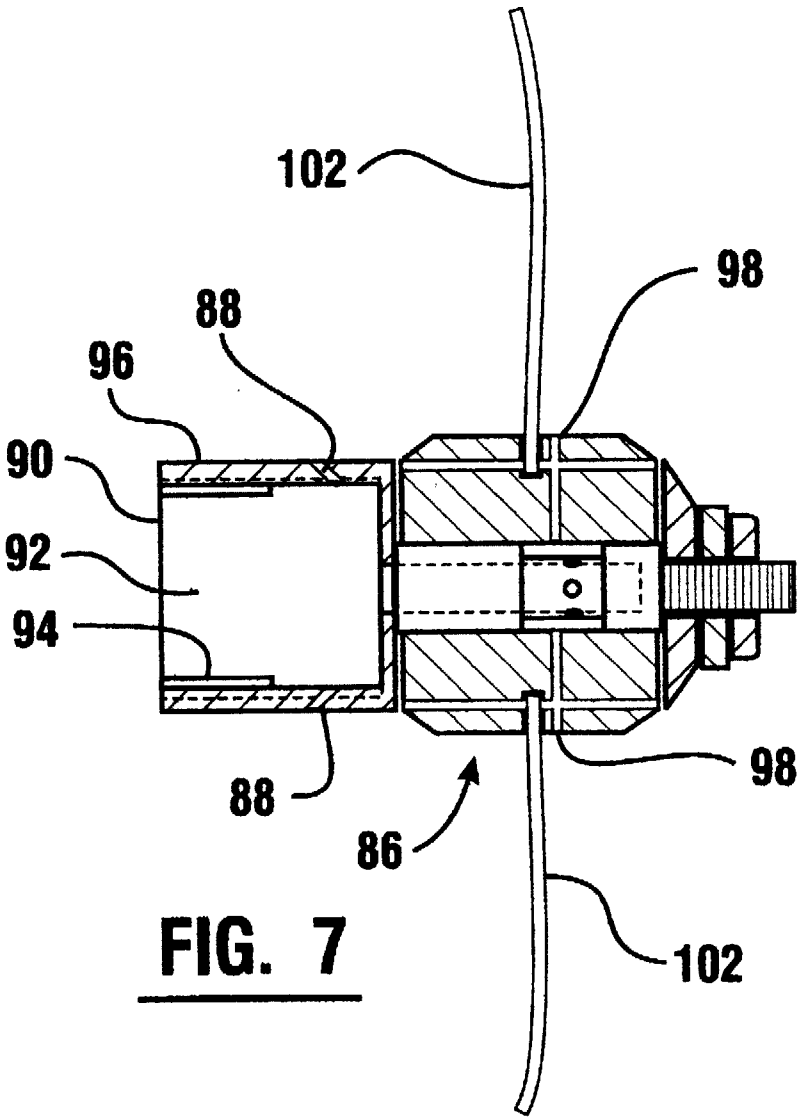
FIG. 7 is a cross sectional view of a third embodiment of the apparatus for cleaning conduits of the present invention.

As described above, the orifices positioned on the annular rotor acts to provide both rotational force and a forward thrust. These two forces may need to be modified separately for different applications, for example when the conduit cleaning apparatus is being fed through the conduit. Referring now to FIG. 7 there is shown a third embodiment of the apparatus for cleaning conduits 86. In this embodiment separate orifices are used for supplying the aforementioned rotational force and forward thrust.

The conduit cleaning apparatus 86 is composed of the same elements as described with respect to the first and second embodiments of the invention. The modification include the position and orientation of the orifices. Reverse thrust orifices 82 are positioned in the base portion 90. Two reverse thrust orifices 88 are positioned on opposed sides of the base portion 90. The reverse thrust orifices originate in the bore 92 forward of any threads 94 or other hose connecting means. The reverse thrust orifices terminate on the outer surface 96 of the base portion. The angle of the orifices through the base portion is 45° in the preferred form of the third embodiment.

Rotational orifices 98 are located in the annular rotor 100. The orifices are positioned tangentially in the annular rotor as described in reference to the first and second embodiments. However the rotational orifices are positioned to direct fluid radially from the annular rotor. When the orifices are so directed they impact at the same location as the wires 102 are impacting. The combined force of the fluid and wires synergistically scours the surface of the conduit walls.

Although two rotational orifices 98 and reverse thrust orifices 88 are shown, any number of orifices can be used as long as they are positioned for a balance flow. The operation of the conduit cleaner apparatus 86 is the same as described with regard to the first and second above described embodiments.

Figure 8:
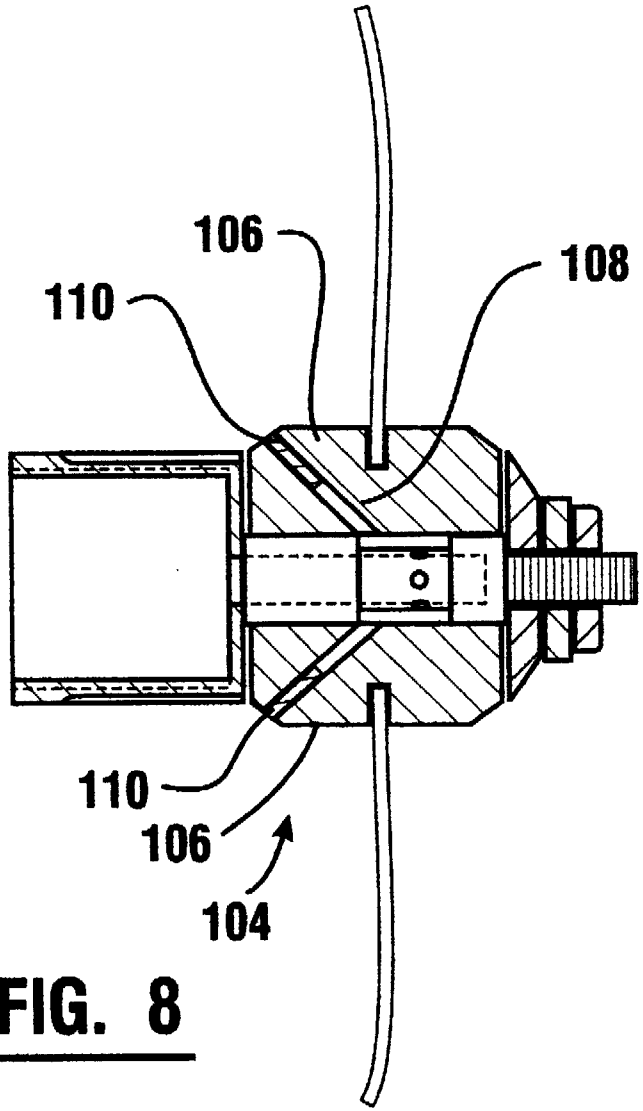
FIG. 8 is a cross sectional view of the apparatus for cleaning conduits with removable nozzles.

As described above, it may be advantageous to the operation of the conduit cleaning apparatus to change the flow rate characteristics of the orifices. This can only be achieved with regard to the first, second and third embodiments by changing out the annular rotor with one appropriately sized orifice. Referring now to FIG. 8, there is shown a fourth embodiment of the conduit cleaning apparatus 104.

The conduit cleaning apparatus 104 includes nozzles 106 removably positioned within each orifice 108. The nozzles act to modulate the flow of fluid through each orifice. The nozzle can act to change the flow rate through the orifice by regulating the pressure drop through the orifice. The nozzle can also be used to modify the spray pattern of the fluid directed outward from the orifice.

Each nozzle includes a fluid passage 110, the dimension of which can be altered for the desired pressure drop and spay pattern, as is well known in the prior art.

A great advantage of the nozzles 106 of this embodiment is that they are easily removable and interchangeable with other nozzles. This interchangeability allows for the replacement of damaged nozzles and rapid change of the conduit cleaning apparatus flow characteristics.

In the preferred form of the fourth embodiment, each orifice 108 is threaded for a distance to allow for the fastening of an outwardly threaded nozzle 106. The nozzle 106 can be securely inserted into the orifice via a hexagonally shaped tap, not shown, which allows for the insertion and removal of each nozzle via an Allen wrench. Other means of securing the nozzle within the orifice are well known and are acceptable as long as they fluidly secure the nozzle within the orifice.

Thus the invention achieves the above stated objectives, eliminates difficulties encountered in the use of prior devices, solves problems and attains the desired results described herein. In the foregoing description, certain terms have been used for brevity, clarity and understanding. However, no unnecessary limitations can be implied there-from because such terms are used for descriptive purposes and are intended to be broadly construed. Moreover the description and illustrations given are by way of examples and the invention is not limited to the exact details shown or described.

Further, in the following claims any feature that is described as a means for performing a function shall be construed as encompassing any means capable of performing the function, and shall be limited to the particular means for performing the function described herein, or mere equivalents.

Having described the features, discoveries and principles of the invention, the manner in which it is constructed, and operated, and the advantages and useful results obtained; the new and useful structures, devices, elements, arrangements, parts, combinations, systems, equipment, operations and relations are set forth in the appending claims.

We claim:

1. A conduit cleaning apparatus comprising:

a generally cylindrical body having a bore, wherein an opening of the bore is adapted for connection with a high pressure fluid source, and wherein said body includes at least one port extending through said body from said bore to an outer surface of said body;

an annular rotor having a central cavity, wherein said annular rotor is rotatably mounted on said body, wherein said annular rotor further includes at least one orifice extending through said annular rotor from said cavity to the exterior of said annular rotor, wherein said at least one orifice is positioned to direct said fluid generally tangential from said rotor, whereby said apparatus is operable to allow fluid to flow from said bore to said port, and then through said at least one orifice, causing the rotation of said annular rotor on said body, wherein the at least one orifice is positioned to direct said fluid behind said apparatus, where the movement of the fluid propels the apparatus in a forward direction, and at least one wire operatively attached to the annular rotor.

2. A conduit cleaning apparatus comprising:

a generally cylindrical body having a bore, wherein an opening of the bore is adapted for connection with a high pressure fluid source, and wherein the body includes at least one port extending through the body from the bore to an outer surface of the body;

an annular rotor having a central cavity, wherein the annular rotor is rotatable mounted in supported connection with the body, wherein the annular rotor further includes at least one orifice extending through the annular rotor from the cavity to the exterior of the annular rotor, wherein the orifice is positioned to direct the fluid generally tangentially from the rotor, whereby the apparatus is operable to enable fluid flow from the bore to the port, and then through the orifice, causing the rotation of the annular rotor relative to the body, further comprising at least one thrust orifice, wherein said at least one thrust orifice is positioned on said body, wherein said at least one thrust orifice is positioned to direct said fluid behind said apparatus wherein said fluid moving backwards forces said apparatus forwards, at least one wire operatively attached to the annular rotor.

3. A conduit cleaning apparatus comprising:

a generally cylindrical body having a bore, wherein an opening of the bore is adapted for connection with a high pressure fluid source, and wherein the body includes at least one port extending through the body from the bore to an outer surface of the body; wherein said outer surface includes a groove extending circumferentially about the exterior of said body, wherein said port extends through said body from said bore to said groove, an annular rotor having a central cavity, wherein the annular rotor is rotatably mounted in supported connection with the body, wherein the annular rotor further includes at least one orifice extending through said annular rotor from the cavity to the exterior of the annular rotor, wherein the orifice is positioned to direct fluid generally tangentially from the rotor, wherein the orifice is positioned in communication with said groove, whereby said fluid flows from said body to said groove, and then through said orifice, causing the rotation of said annular rotor relative to the body.

at least one wire operatively attached to the annular rotor.

4. A conduit cleaning apparatus comprising:

a generally cylindrical body having a bore, wherein an opening of the bore is adapted for connection with a high pressure fluid source, and wherein the body includes at least one port extending through the body from the bore to an outer surface of said body;

an annular rotor having a central cavity, wherein the annular rotor is rotatably mounted in supported connection with the body, wherein the annular rotor further includes at least one orifice extending through the annular rotor from the cavity to the exterior of the annular rotor, wherein the orifice is positioned to direct fluid generally tangentially from the rotor, whereby the apparatus is operable to enable fluid to flow from the bore to the port, and then through the orifice, causing the rotation of said annular rotor relative to the body, wherein said annular rotor includes at least one reverse orifice, wherein said reverse orifice is positioned to direct said fluid generally tangentially from said rotor and in an opposite direction, wherein said fluid flowing in said opposite direction slows the rotation of said annular rotor, at least one wire operatively attached to the annular rotor.

5. A conduit cleaning apparatus comprising:

a generally cylindrical body having a bore, wherein an opening of the bore is adapted for connection with a high pressure fluid source, and wherein the body includes at least one port extending through the body from the bore to an outer surface of the body;

an annular rotor having a central cavity, wherein the annular rotor is rotatably mounted in supported connection with the body, wherein the annular rotor further includes at least one orifice extending through the annular rotor from the cavity to the exterior of the annular rotor, wherein the orifice is positioned to direct fluid generally tangentially from the rotor, whereby the apparatus is operable to enable fluid to flow from the bore to the port, and then through the orifice, causing the rotation of the annular rotor relative to the body; and at least one wire operatively attached to the annular rotor, wherein said wire extends through said annular rotor and is fixed within said annular body, wherein a portion of said wire extends from opposed outer surfaces of said annular rotor.

6. A conduit cleaning apparatus comprising:

a generally cylindrical body having a bore, wherein an opening of the bore is adapted for connection with a high pressure fluid source, and wherein the body includes at least one port extending through the body from the bore to an outer surface of the body; wherein said body is in operative fluid communication with said high pressure fluid source through a hose, a lead line, wherein said lead line is operatively fluidly connected to both said body and said hose, wherein said lead line is operative to communicate fluid from said hose to said body, wherein said lead line is flexible and when said apparatus is placed within a conduit said lead line allows said body to move to a position disposed from all surfaces of said conduit;

an annular rotor having a central cavity, wherein the annular rotor is rotatably mounted in supported connection with the body, wherein the annular rotor further includes at least one orifice extending through the annular rotor from the cavity to the exterior of the annular rotor, wherein the orifice is positioned to direct the fluid generally tangentially from the rotor, whereby the apparatus is operable to enable fluid to flow from the bore to the port, and then through the orifice, causing the rotation of the annular rotor relative to the body; and at least one wire operatively attached to the annular rotor.

7. A conduit cleaning apparatus comprising:

a generally cylindrical body having a bore, wherein an opening of the bore is adapted for connection with a high pressure fluid source, and wherein the body includes at least one port extending through the body from the bore to an outer surface of the body;

an annular rotor having a central cavity, wherein the annular rotor is rotatably mounted in supported connection with the body, wherein the annular rotor further includes at least one orifice extending through the annular rotor from the cavity to the exterior of the annular rotor, wherein the orifice is positioned to direct the fluid generally tangentially from the rotor, whereby the apparatus is operable to enable fluid flow from the bore to the port, and then through the orifice, causing the rotation of the annular rotor relative to the body; and at least one wire operatively attached to the annular rotor, a stop, wherein said stop is connected to said body to hold the axial position of said annular rotor on said body.

8. The apparatus according to claim 7, further comprising a bearing, wherein said bearing is interposed between said stop and said annular rotor, wherein said bearing decreases the friction between said stop and said annular rotor.

9. The apparatus according to claim 7 wherein said annular rotor further comprises an annular bearing, wherein said annular bearing is positioned adjacent said central cavity, wherein said annular bearing decreases the friction between said stop and said annular rotor.

10. The apparatus according to claim 9, wherein said at least one orifice extends through said annular bearing.

11. A conduit cleaning apparatus comprising:

a generally cylindrical body having a bore, wherein an opening of the bore is adapted for connection with a high pressure fluid source, and wherein the body includes at least one port extending through the body from the bore to an outer surface of the body;

an annular rotor having a central cavity, wherein the annular rotor is rotatably mounted in supported connection with the body, wherein the annular rotor further includes at least one orifice extending through the annular rotor from the cavity to the exterior of the annular rotor, wherein the orifice is positioned to direct fluid generally tangentially from the rotor, whereby the apparatus is operable to enable fluid flow from the bore to the port, and then through the orifice, causing the rotation of said annular rotor relative to the body;

at least one nozzle, wherein the nozzle is positioned within an orifice, wherein said nozzle is removable from said orifices, at least one wire operatively attached to the annular rotor.

12. The apparatus according to claim 11, wherein each said at least one orifice is threaded, and wherein each said at least one nozzle is threadably insertable within said at least one orifice.

13. A conduit cleaning apparatus comprising:

a generally cylindrical body having a bore, wherein said body extends between a first end and a second end, wherein an opening of said bore adjacent said first end is adapted for connection with a high pressure fluid source, wherein the diameter of said second end of said body is reduced, wherein said second end of said body includes at least one port extending through said second end from said bore to an outer surface of said second end;

an annular rotor having a central cavity, wherein said annular rotor is rotatably mounted on said second end of said body, wherein said annular rotor further includes at least one orifice, wherein said orifice is in fluid communication with said bore; and at least one wire attached to said annular rotor.

14. The conduit cleaning apparatus of claim 13 wherein said at least one wire extends through said annular rotor and is fixed within said annular body, wherein a portion of said wire extends from opposed outer surfaces of said annular rotor.

* * * * *